US007316209B2

(12) United States Patent
Akiba et al.

(10) Patent No.: US 7,316,209 B2
(45) Date of Patent: Jan. 8, 2008

(54) COMBUSTION TYPE POWER TOOL HAVING BUFFER PIECE

(75) Inventors: Yoshitaka Akiba, Hitachinaka (JP); Haruhisa Fujisawa, Hitachinaka (JP); Tomomasa Nishikawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/802,956

(22) Filed: May 29, 2007

(65) Prior Publication Data

US 2007/0227477 A1 Oct. 4, 2007

Related U.S. Application Data

(63) Continuation of application No. 11/175,176, filed on Jul. 7, 2005, now Pat. No. 7,225,768.

(30) Foreign Application Priority Data

Jul. 9, 2004 (JP) ..... P2004-203886

(51) Int. Cl.
*F02B 71/00* (2006.01)

(52) U.S. Cl. ..... 123/46 SC; 227/10

(58) Field of Classification Search ..... 123/46 R, 123/46 SC; 227/10
See application file for complete search history.

(56) References Cited

U.S. PATENT DOCUMENTS

| | | | | |
|---|---|---|---|---|
| 2,403,034 | A * | 7/1946 | Weyandt et al. | 227/131 |
| 4,403,722 | A | 9/1983 | Nikolich | |
| 4,483,280 | A | 11/1984 | Nikolich | |
| 5,203,093 | A | 4/1993 | Baker | |
| 5,713,313 | A | 2/1998 | Berry | |
| 5,959,379 | A | 9/1999 | Hu | |
| 6,619,527 | B1 | 9/2003 | Moeller | |
| 7,040,520 | B2 | 5/2006 | Turk | |
| 7,073,468 | B2 | 7/2006 | Akiba | |
| 2004/0173657 | A1 | 9/2004 | Turk | |
| 2005/0173485 | A1 | 8/2005 | Moeller | |
| 2005/0218179 | A1 | 10/2005 | Akiba | |
| 2005/0225184 | A1 | 10/2005 | Akiba | |
| 2006/0186166 | A1 | 8/2006 | Akiba | |

FOREIGN PATENT DOCUMENTS

| | | |
|---|---|---|
| EP | 1 197 300 | 4/2002 |
| EP | 1 488 891 | 12/2004 |
| EP | 1 588 804 | 10/2005 |

* cited by examiner

*Primary Examiner*—Noah P. Kamen
(74) *Attorney, Agent, or Firm*—Antonelli, Terry, Stout & Kraus, LLP.

(57) ABSTRACT

A combustion-type power tool includes a housing, a cylinder disposed, a piston, and a cylinder head disposed at an end of the housing and having a wall portion extending in a direction perpendicular to an axial direction, the wall portion having an opening. A motor is disposed at the cylinder head and includes a motor body and a drive shaft extending from the motor body into a combustion chamber through the opening of the wall portion of the cylinder head, a fan is connected to the drive shaft to be rotatable within the combustion chamber, and an elastic member is disposed at the opening of the wall portion and has a sleeve portion extending in the axial direction. The sleeve portion has a through-hole through which the drive shaft extends, and an inner surface of the through-hole is tapered with respect to an outer surface of the drive shaft.

13 Claims, 6 Drawing Sheets

COMBUSTION TYPE POWER TOOL HAVING BUFFER PIECE

CROSS REFERENCE TO RELATED APPLICATION

This application is a continuation of U.S. application Ser. No. 11/175,176, filed Jul. 7, 2005 now U.S. Pat. No. 7,225,768, the contents of which are incorporated herein by reference.

BACKGROUND OF THE INVENTION

The present invention relates to a combustion-type power tool, and more particularly, to such power tool capable of driving a fastener such as a nail, an anchor, and a staple into a workpiece.

A combustion type power tool provides high operability in comparison with a pneumatically operated power tool requiring a compressor and a hose. In a conventional combustion-type driving tool such as a nail gun, a gaseous fuel injected into a combustion chamber is ignited to cause gas expansion in the combustion chamber, which in turn causes a linear momentum of a piston. By the movement of the piston, a nail is driven into a workpiece. In order to improve combustion, a motor having a motor shaft is supported to a cylinder head, and a fan connected to the motor shaft is disposed in the combustion chamber for agitating a combustible gas. Further, a bumper is disposed to absorb kinetic energy of the piston moving toward the workpiece. Such conventional combustion-type driving tool is disclosed in U.S. Pat. No. 4,483,280.

The motor is reciprocally moved relative to the cylinder head in the sliding direction of the piston at the explosion timing and bumping timing of the piston against the bumper. To this effect, a predetermined gap is provided between the motor shaft and the cylinder head.

SUMMARY OF THE INVENTION

The present inventors have discovered the following drawbacks in the conventional combustion type power tool. First, the motor may also be laterally vibrated in a direction perpendicular to the sliding direction of the piston. The lateral vibration of the motor may allow the motor shaft to strike against the cylinder head to generate noise and to damage to the motor shaft and to the cylinder head. Second, a pressure leakage may occur through the gap between the motor shaft and the cylinder head at the time of explosion to reduce the pressure for driving the piston, to thus lower the driving power. Third, an effect of "thermal vacuum" is lowered since the gap is communicated with an atmosphere. Therefore, the movement of the piston toward its top dead center is lowered after the nail driving operation to lower the entire efficiency of the power tool.

It is therefore, an object of the present invention to provide a combustion type power tool with a simple arrangement and produced at a low cost yet capable of maintaining high operability avoiding noise generation and power reduction.

This and other object of the present invention will be attained by a combustion-type power tool including a housing, a cylinder head, a cylinder, a piston, a combustion-chamber frame, a motor, a fan, and a buffer piece. The cylinder head is disposed at one end of the housing. The cylinder is disposed in and fixed to the housing. The piston is reciprocally movable in the longitudinal direction of the housing and is slidable relative to the cylinder. The piston divides the cylinder into an upper space above the piston and a lower space below the piston. The combustion-chamber frame is disposed in the housing and is movable in the longitudinal direction. The combustion chamber frame is abuttable on the cylinder head to provide a combustion chamber in cooperation with the cylinder head and the piston. The motor is disposed at the cylinder head and includes a motor body and a drive shaft extending from the motor body in the longitudinal direction and protruding into the combustion chamber. The fan is connected to the drive shaft to be rotatable within the combustion chamber. The buffer piece is made from an elastic material and is supported to the cylinder head. The buffer piece is movable relative to the cylinder head. The buffer piece is formed with a through-hole through which the drive shaft extends.

In another aspect of the invention, there is provided a shock absorbing structure for a motor having a motor body and a drive shaft that rotates a fan rotatable in a combustion chamber in a combustion-type power tool for driving a fastener into a workpiece. The power tool includes a tool body having a cylinder head and generates an acceleration of the motor in an axial direction of the fan upon combustion in the combustion chamber. The acceleration causes the motor to move in the axial direction relative to the tool body as well as to move in the direction perpendicular to the axial direction. The shock absorbing structure includes a buffer piece made from an elastic material and supported to the cylinder head. The buffer piece is movable relative to the cylinder head in a direction substantially perpendicular to the axial direction. The buffer piece is formed with a through-hole through which the drive shaft extends.

In still another aspect of the invention, there is provided with a combustion-type power tool including the housing, the cylinder head, the a cylinder, the piston, the combustion-chamber frame, the motor, the fan, the buffer piece, and a washer. The through-hole of the washer has a minimum inner diameter. The washer is disposed in the buffer piece and has an inner diameter smaller than the minimum inner diameter.

DETAILED DESCRIPTION OF THE PREFERRED EMBODIMENTS

Figure 1:
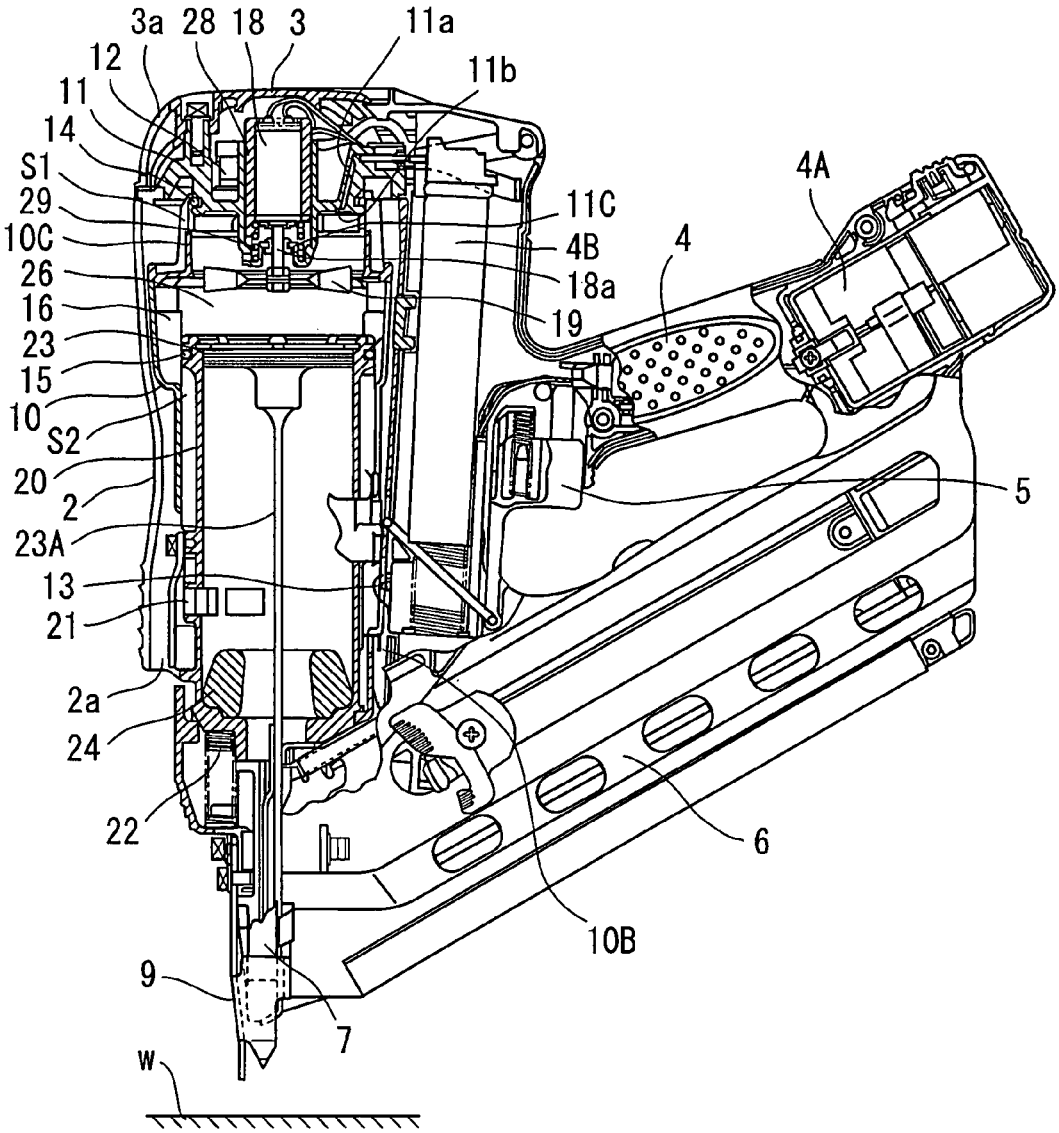
FIG. 1 is a vertical cross-sectional side view showing a combustion type nail gun embodying a combustion type power tool according to a first embodiment of the present invention, the nail gun being in an initial phase.
Figure 2:
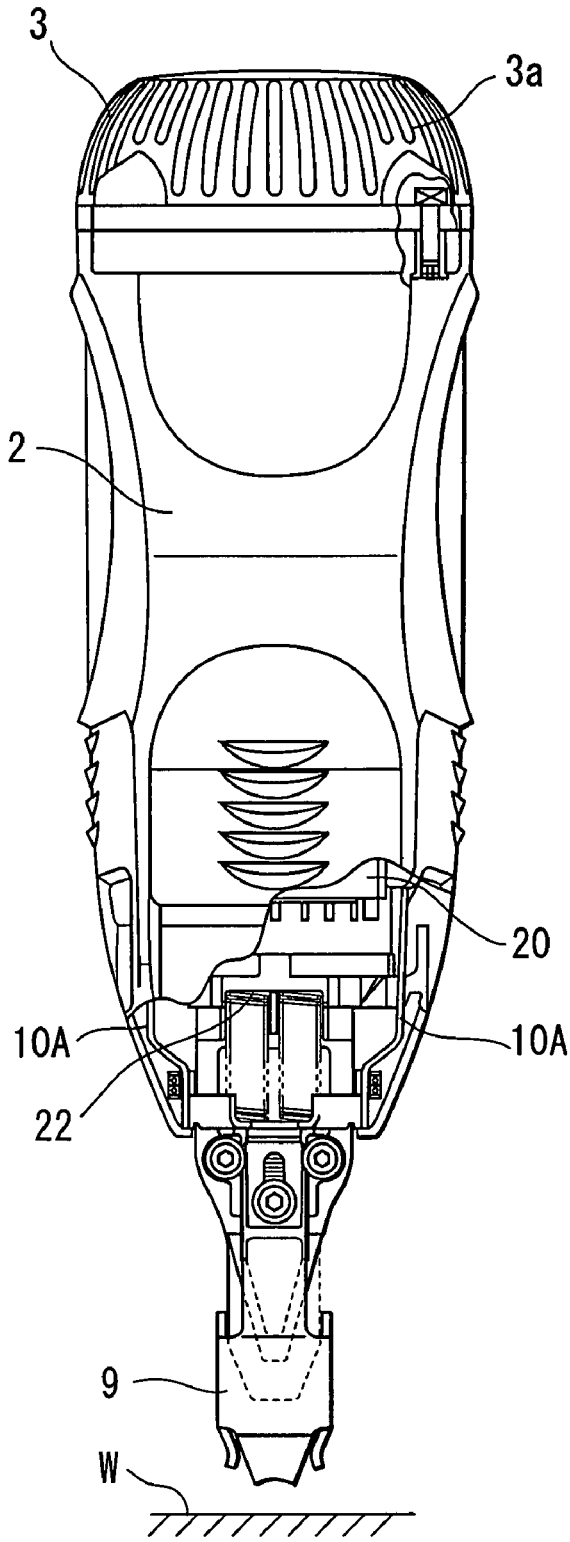
FIG. 2 is a front view partially cut-away showing the nail gun according to the first embodiment.

A combustion-type power tool according to a first embodiment of the present invention will be described with reference to FIGS. 1 through 4. The embodiment pertains to a combustion type nail gun. The combustion type nail gun 1 has a housing 2 constituting an outer frame. A head cover 3 formed with an intake port 3*a* is mounted on the top of the housing 2. A handle 4 is attached to the housing 2 and extends from a side of the housing 2. The handle 4 has a trigger switch 5 and accommodates therein a battery 4A. A canister housing is provided in the handle 4 at a position immediately beside the housing 2. A gas canister 4B containing therein a combustible gas is detachably disposed in the canister housing. A magazine 6 is provided at a lower side of the handle 4. The magazine 6 contains nails (not shown). The housing 2 has a lower portion formed with an exhaust port 2*a* for discharging a combustion gas to the atmosphere.

A nose 7 extends from a lower end of the housing 2. The nose 7 is formed integrally with a cylinder 20 (described later) and has a tip end in confrontation with a workpiece W. The nose 7 is adapted for guiding sliding movement of a drive blade 23A (described later) and for setting the nail to a predetermined position. A push lever 9 is movably provided and has a lower portion slidable with respect to the lower end portion of the nose 7. The push lever 9 is coupled to an arm member 10A (FIG. 2) that is engaged with a combustion-chamber frame 10 which will be described later through a pin (not shown). A compression coil spring 22 is interposed between the arm member 10A and the cylinder 20 for normally urging the push lever 9 in a protruding direction from the housing 2. When the housing 2 is pressed toward a workpiece W while the push lever 9 is in abutment with the workpiece W against a biasing force of the compression coil spring 22, an upper portion of the push lever 9 is retractable into the housing 2.

A cylinder head 11 is secured to the top of the housing 2 for closing the open top end of the housing 2. The cylinder head 11 supports a motor 18 at a position opposite to a combustion chamber 26 described later. Further, an ignition plug 12 is also supported to the cylinder head 11 at a position adjacent to the motor 18. The ignition plug 12 has an ignition spot exposed to the combustion chamber 26. The ignition plug 12 is ignitable upon manipulation to the trigger switch 5. An injection rod (not shown) is provided at the cylinder head 11.

A push switch 13 is provided in the housing 2 for detecting an uppermost stroke end position of the combustion-chamber frame 10 when the nail gun 1 is pressed against the workpiece W. More specifically, a projection 10B is provided at the combustion chamber frame 10. When the push switch 13 detects the projection 10B, the uppermost stroke end position of the combustion chamber frame 10 is detected. Thus, the push switch 13 can be turned ON when the push lever 9 is elevated to a predetermined position for starting rotation of the motor 18.

The cylinder head 11 has a handle side in which is formed a fuel ejection passage 11*a* which allows a combustible gas to pass therethrough. One end of the ejection passage 11*a* serves as an ejection port 11*b* that opens at the lower surface of the cylinder head 11. Another end of the ejection passage 11*a* serves as a gas canister connecting portion in communication with the injection rod.

The combustion-chamber frame 10 is provided in the housing 2 and is movable in the lengthwise direction of the housing 2. An uppermost end portion 10C of the combustion-chamber frame 10 is abuttable on the lower peripheral side of the cylinder head 11. Since the arm member 10A connects the combustion-chamber frame 10 to the push lever 9, the combustion-chamber frame 10 is movable in interlocking relation to the push lever 9. An upper seal ring 14 is disposed at the cylinder head 11. The uppermost end portion 10C of the combustion chamber frame 10 is in sealing contact with the upper seal ring 14 when the combustion chamber frame 10 is at is top dead center.

The cylinder 20 is fixed to the housing 2. The cylinder 20 has an axially intermediate portion formed with an exhaust hole 21. An exhaust-gas check valve (not shown) is provided to selectively close the exhaust hole 21. Further, a bumper 24 is provided on the bottom of the cylinder 20. The cylinder 20 has an upper end portion provided with a lower seal ring 15. The combustion chamber frame 10 can be selectively contacted with the lower seal ring 15 to provide the sealed combustion chamber 26.

A piston 23 is slidably and reciprocally provided in the cylinder 20. The piston 23 divides an inner space of the cylinder 20 into an upper space above the piston 23 and a lower space below the piston 23. The driver blade 23A extends downwards from a side of the piston 23, the side being at the cylinder space below the piston 23, to the nose 7. The driver blade 23A is positioned coaxially with the nail setting position in the nose 7, so that the driver blade 23A can strike against the nail during movement of the piston 23 toward its bottom dead center. The bumper 24 is made from a resilient material. When the piston 23 moves to its bottom dead center, the piston 23 abuts on the bumper 24 and stops. In this case, the bumper 24 absorbs a surplus energy of the piston 23.

When the upper end of the combustion-chamber frame 10 abuts on the cylinder head 11, the cylinder head 11, the combustion-chamber frame 10, the upper cylinder space above the piston 23 define in combustion the combustion chamber 26. When the combustion-chamber frame 10 is separated from the cylinder head 11, a first flow passage S1 in communication with an atmosphere is provided between the cylinder head 11 and the upper end portion 10C of the combustion-chamber frame 10, and a second flow passage S2 in communication with the first flow passage is provided between the lower end portion of the combustion-chamber frame 10 and the upper end portion of the cylinder 20. These flow passages S1, S2 allow a combustion gas and a fresh air to pass along the outer peripheral surface of the cylinder 20 for discharging these gas through the exhaust port 2*a* of the housing 2. Further, the above-described intake port 3*a* is formed for supplying a fresh air into the combustion chamber 26, and the exhaust hole 21 is adapted for discharging combustion gas generated in the combustion chamber 26.

The motor 18 has a drive shaft 18*a* and is supported to the cylinder head 23. The fan 19 is disposed in the combustion chamber 26. Rotation of the fan 19 performs the following three functions. First, the fan 19 stirs and mixes the air with the combustible gas as long as the combustion-chamber frame 10 remains in abutment with the cylinder head 11. Second, after the mixed gas has been ignited, the fan 19 causes turbulent combustion of the air-fuel mixture, thus promoting the combustion of the air-fuel mixture in the combustion chamber 26. Third, the fan 19 performs scavenging such that the exhaust gas in the combustion chamber 26 can be scavenged therefrom and also performs cooling to the combustion-chamber frame 10 and the cylinder 20 when the combustion-chamber frame 10 moves away from the cylinder head 11 and when the first and second flow passages S1, S2 are provided.

A plurality of ribs 16 are provided on the inner peripheral portion of the combustion-chamber frame 10 which portion defines the combustion chamber 26. The ribs 16 extend in the lengthwise direction of the combustion-chamber frame 10 and project radially inwardly toward the axis of the housing 2. The ribs cooperate with the rotating fan 19 to promote stirring and mixing of air with the combustible gas in the combustion chamber 26.

Figure 3:
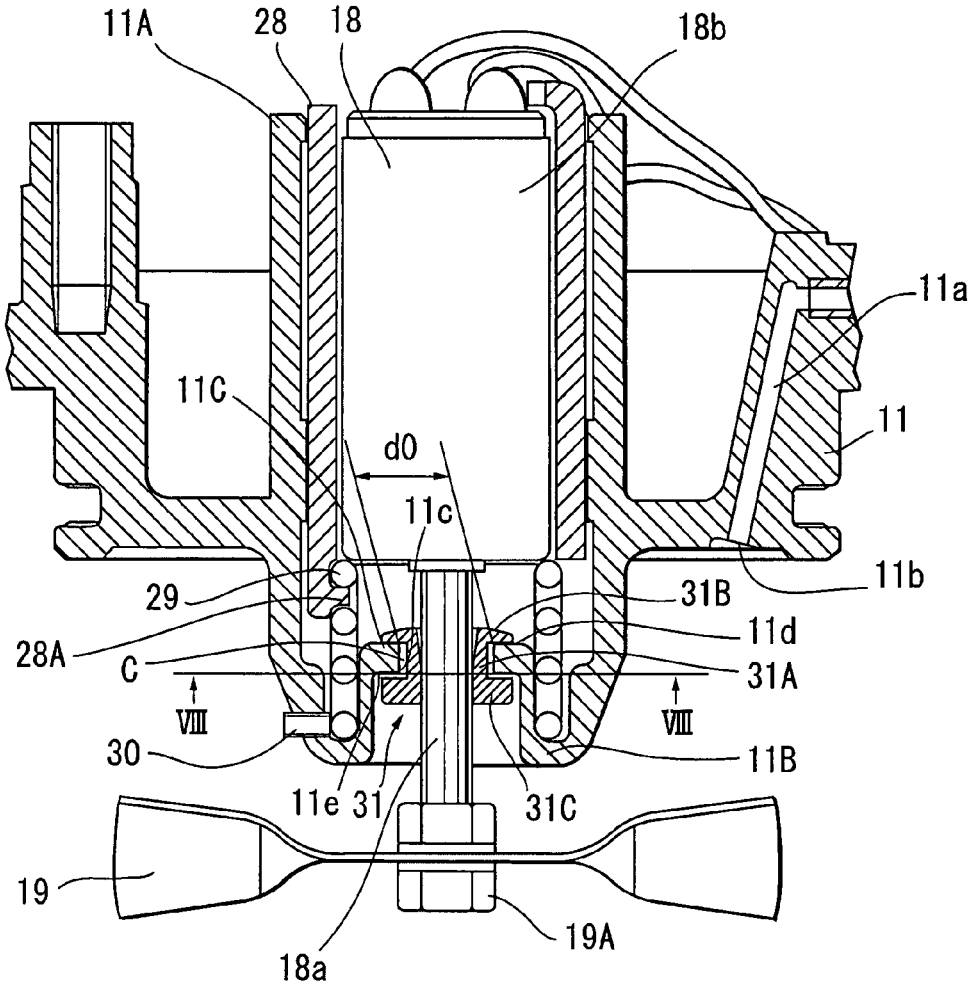
FIG. 3 is a cross-sectional view particularly showing a motor, a motor shaft and a cylinder head in the nail gun according to the first embodiment.

Next, a motor supporting arrangement will be described in detail with reference to FIGS. 3 and 4. The cylinder head 11 has a concave region 11A. The concave region 11A has a lowermost spring seat section 11B and a buffer support section 11C. The buffer support section 11C is formed with a center hole 11*c*, and has a first surface 11*d* and a second surface 11*e*. The center hole 11*c* provides an inner diameter of d0.

The fan 19 is fixed to the drive shaft 18*a* of the motor 18 by a nut 19A. In the concave section 11A, a motor case 28 is axially movably provided. The motor case 28 has an engagement section 28A. The motor 18 has a motor body 18*b* fitted in the motor case 28. A coil spring 29 is disposed in the concave region 11A. One end of the coil spring 29 is fixed to the spring seat section 11B by a screw 30 threadingly engaged with the spring seat section 11B. Another end of the coil spring 29 is nipped between the motor body 18*b* and the engagement section 28A of the motor case 28.

A buffer piece 31 is loosely held by the buffer support section 11C. The buffer piece 31 is made from an elastic material such as a rubber. The buffer piece 31 is slightly movable in a direction perpendicular to the axial direction of the drive shaft 18*a* of the motor 18. The buffer piece 31 includes a sleeve portion 31A loosely disposed in the center hole 11*c* and having an outer diameter d3 (FIG. 4) smaller than the inner diameter d0 of the center hole 11*c* in order to provide an annular clearance C between the center hole 11*c* and the sleeve portion 31A. A dimension of the clearance C is configured in order to avoid excessive pressed deformation or crush of the buffer piece 31 when the motor 18 is accidentally tilted at a maximum angle due to the combustion/explosion pressure so as to still permit the buffer piece 31 to be laterally movable along with the drive shaft 18*a*.

The buffer piece 31 also includes a generally circular first flange 31B provided at one axial end of the sleeve portion 31A and in contact with the first surface 11*d*, and a generally circular second flange 31C provided at another axial end of the sleeve portion 31A and in contact with the second surface 11*e*. An axial length of the sleeve portion 31A is greater than a distance between the first and second contact surfaces 11*d* and 11*e*. Therefore, the buffer piece 31 can also be movable in the axial direction relative to the cylinder head ii.

Figure 4:
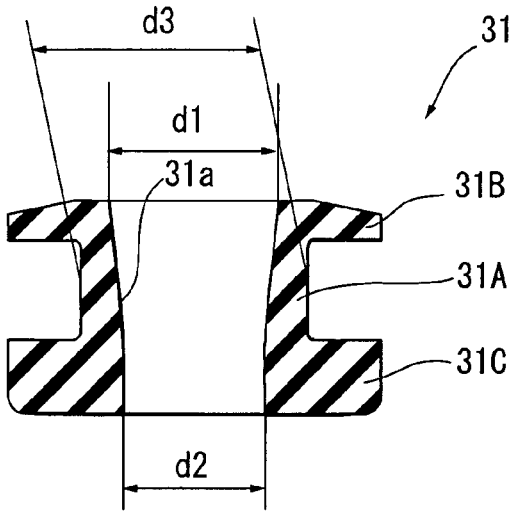
FIG. 4 is an enlarged cross-sectional view of a buffer piece assembled at the cylinder head in the nail gun according to the first embodiment.

Further, as shown in FIG. 4, the buffer piece 31 is formed with a tapered bore 31*a* for allowing the drive shaft 18*a* to pass therethrough. The tapered bore 31*a* has an inner diameter d1 at the open end at the first flange 31B and has another inner diameter d2 smaller than d1 at another open end at the second flange 31B. If the inner diameter d1 is equal to the inner diameter d2, the bore portion at the first flange 31B may be frictionally worn due to the inclination of the motor shaft 18*b* when the motor 18 is accidentally tilted upon application of the combustion/explosion pressure. Incidentally, since the buffer piece 31 is an integral product and can be produced by a molding, the buffer piece 31 can be produced easily.

Next, operation of the combustion type nail gun 1 will be described. In the non-operational state of the combustion type nail gun 1, the push lever 9 is biased away from the cylinder head 11 in FIG. 1 by the biasing force of the compression coil spring 22, so that the push lever 9 protrudes from the lower end of the nose 7. Thus, the uppermost end portion 10C of the combustion-chamber frame 10 is spaced away from the cylinder head 1 because the arm member 10A connects the combustion-chamber frame 10 to the push lever 9. Further, a part of the combustion-chamber frame 10 which part defines the combustion chamber 26 is also spaced from the top portion of the cylinder 20. Hence, the first and second flow passages S1 and S2 are provided. In this condition, the piston 23 stays at its top dead center in the cylinder 20.

With this state, if the push lever 9 is pushed onto the workpiece W while holding the handle 4 by a user, the push lever 9 is moved toward the cylinder head 11 against the biasing force of the compression coil spring 22. At the same time, the combustion-chamber frame 10 which is coupled to the push lever 9, is also moved toward the cylinder head 11, closing the above-described flow passages S1 and S2. Thus, the sealed combustion chamber 26 is provided.

In accordance with the movement of the push lever 9, the gas canister 4B is tilted toward the cylinder head 11 by an action of a cam (not shown). Thus, the injection rod is pressed against the connecting portion of the cylinder head 11. Therefore, the liquidized gas in the gas canister 4B is ejected once into the combustion chamber 26 through the ejection port 11*b* of the ejection passage 11*a*.

Further, in accordance with the movement of the push lever 9, the combustion-chamber frame 10 reaches its uppermost stroke end whereupon the push switch 13 is turned ON to energize the motor 18 for starting rotation of the fan 19. Rotation of the fan 19 stirs and mixes the combustible gas with air in the combustion chamber 26 in cooperation with the ribs 16.

In this state, when the trigger switch 5 provided at the handle 4 is turned ON, spark is generated at the ignition plug 12 to ignite the combustible gas by way of an ignition circuit (not shown). The combusted and expanded gas pushes the piston 23 to its bottom dead center. Therefore, a nail in the nose 7 is driven into the workpiece W by the driver blade 23A until the piston 23 abuts on the bumper 24.

After the nail driving, the piston 23 strikes against the bumper 24, the cylinder space above the piston 23 becomes communicated with the exhaust hole 21. Thus, the high pressure and high temperature combustion gas is discharged out of the cylinder 20 through the exhaust hole 21 of the cylinder 20 and through the check valve (not shown) provided at the exhaust hole 21 to the atmosphere to lower the pressure in the combustion chamber 26. When the inner space of the cylinder 20 and the combustion chamber 26 becomes the atmospheric pressure, the check valve is closed.

By the combustion and explosion of the air-fuel mixture, the fan 19 is subjected to back pressure impact. Thus, acceleration is to be imparted on the motor 18 connecting to the fan 19. Further, the piston 23 consumes surplus kinetic energy as a result of impingement onto the bumper 24 in addition to the fastener driving energy. In this instance, acceleration due to the surplus energy is imparted on the entire nail gun 1, and therefore, the acceleration is to be also transmitted to the motor 18. Thus, a combined acceleration is to be imparted on the motor 18. Thus, the motor 18 may be vibrated in the axial direction of the drive shaft 18*a*, and also may be vibrated in the lateral direction, i.e., in the direction perpendicular to the axial direction.

However, since the buffer piece 31 is interposed between the drive shaft 18*a* and the buffer support section 11C of the cylinder head 11, and since the buffer piece 31 is movable in the diametrical direction of the center hole 11*c*, sufficient shock absorbing function can be obtained to avoid direct striking of the drive shaft 18*a* against the cylinder head 11 to thus protect the drive shaft 18*a* and the cylinder head 11 and to reduce noise generation. Further, even if the buffer piece 31 is displaced due to the inclination of the drive shaft 18*a*, the first and second flanges 31B and 31C can avoid disengagement of the buffer piece 31 from the buffer support section 11C, since the first and second flanges 31B and 31C are in contact with the first and second contact surfaces 11*d* and 11*e*, respectively.

Combustion gas still remaining in the cylinder 20 and the combustion chamber 26 has a high temperature at a phase immediately after the combustion. However, the high temperature can be absorbed into the walls of the cylinder 20 and the combustion-chamber frame 10 to rapidly cool the combustion gas. Thus, the pressure in the sealed space in the cylinder 20 above the piston 23 further drops to less than the atmospheric pressure (creating a so-called "thermal vacuum"). Accordingly, the piston 23 is moved back to the initial top dead center position.

Then, the trigger switch 5 is turned OFF, and the user lifts the combustion type nail gun 1 from the workpiece W for separating the push lever 9 from the workpiece W. As a result, the push lever 9 and the combustion-chamber frame 10 move away from the cylinder head 11 because of the biasing force of the compression coil spring 22 to restore a state shown in FIG. 1. Thus, the combustion chamber 26 becomes communicated with the atmosphere through the intake port 3*a* and through the first flow passage S1. In this case, the fan 19 keeps rotating for a predetermined period of time in spite of OFF state of the trigger switch 5 because of an operation of a control portion (not shown). In the state shown in FIG. 1, the flow passages S1 and S2 are provided again at the upper and lower sides of the combustion chamber 26, so that fresh air flows into the combustion chamber 26 through the intake port 3*a* formed at the head cover 3 and through the flow passages S1, S2, expelling the residual combustion gas out of the exhaust port 2*a*. Thus, the combustion chamber 26 is scavenged. Then, the rotation of the fan 19 is stopped to restore an initial stationary state. Thereafter, subsequent nail driving operation can be performed by repeating the above described operation process.

Figure 5:
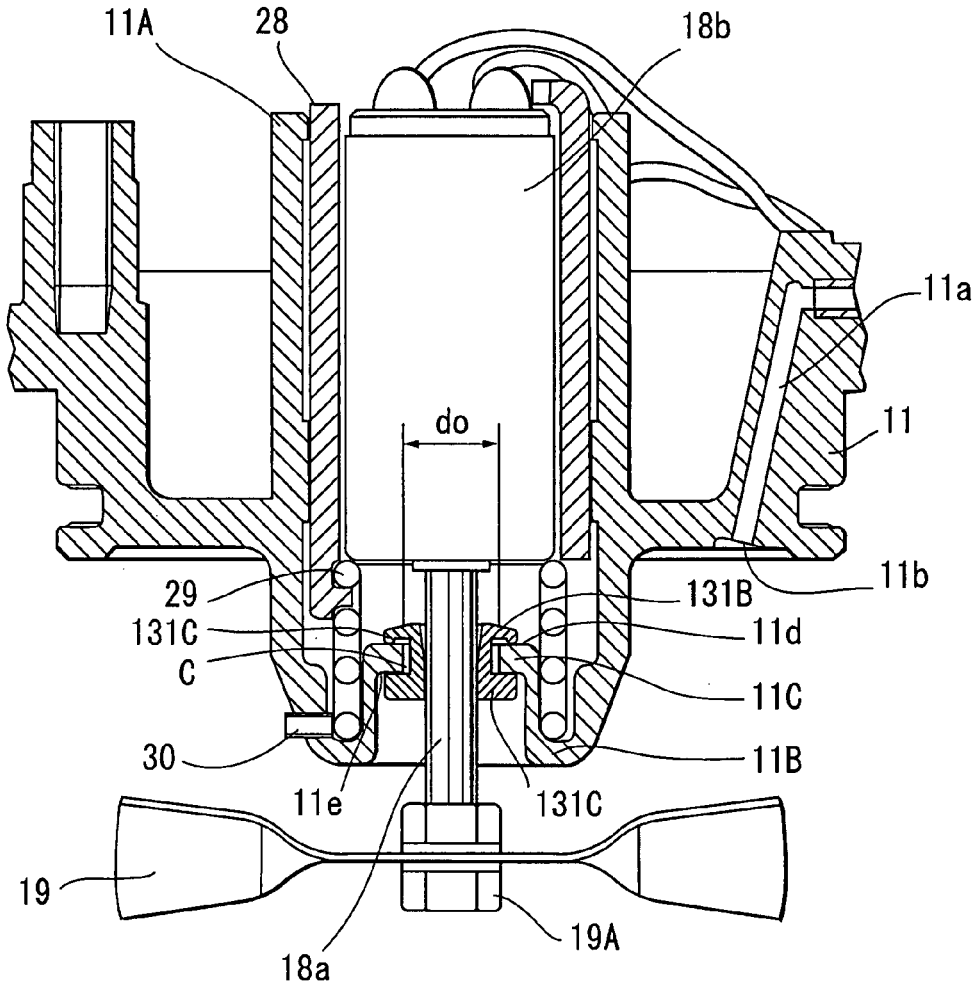
FIG. 5 is a cross-sectional view particularly showing a motor, a motor shaft and a cylinder head in a nail gun according to a second embodiment of the present invention.

A combustion-type power tool according to a second embodiment of the present invention will be described with reference to FIGS. 5 and 6 wherein like parts and components are designated by the same reference numerals as those shown in FIGS. 1 through 4. The embodiment pertains to a modification to the buffer piece 31 in the first embodiment. The second embodiment pertains to an improvement on the first embodiment in terms of pressure leakage at the time of combustion and explosion through the annular clearance C between the center hole 11*c* and the sleeve portion 31A. The clearance C may locally expand due to lateral displacement of the buffer piece 31.

According to the second embodiment, a buffer piece 131 has an annular protrusion 131D at a first flange 131B. The annular protrusion 131D protrudes from an outer peripheral end portion of the first flange 131B toward the first contact surface 11*d* of the buffer support section 11C. The annular protrusion 131D is always seated on the first contact surface 11*d* of the cylinder head 11. Thus, the combustion chamber 26 can be hermetically maintained at the time of combustion to avoid pressure drop. Incidentally, in the second embodiment, the inner diameter d1 is greater than the inner diameter d2 like the first embodiment.

Figure 7:
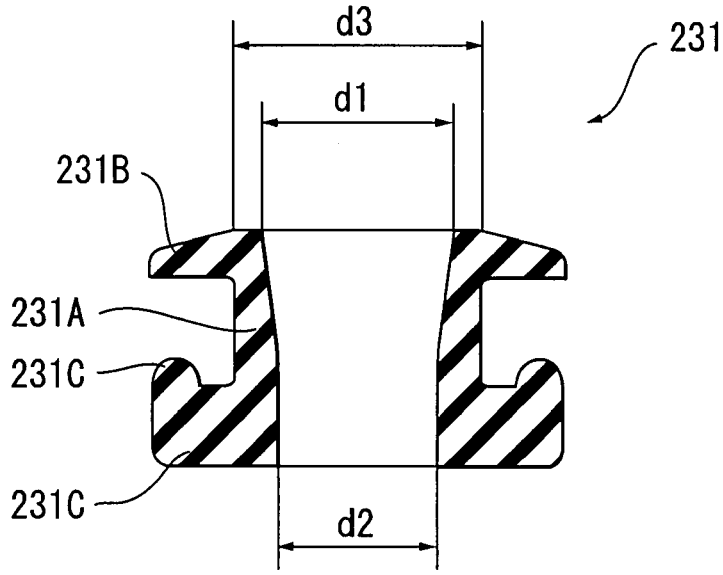
FIG. 7 is an enlarged cross-sectional view of a buffer piece in a nail gun according to a third embodiment of the present invention.

A buffer piece 231 in a combustion type power tool according to a third embodiment is shown in FIG. 7. The buffer piece 231 has an annular protrusion 231D at second flange 231C. The annular protrusion 231D protrudes from an outer peripheral end portion of the second flange 231C toward the second contact surface 11*e* of the buffer support section 11C. The function and effect of the buffer piece 231 is the same as those of the buffer piece 131.

Figure 8:
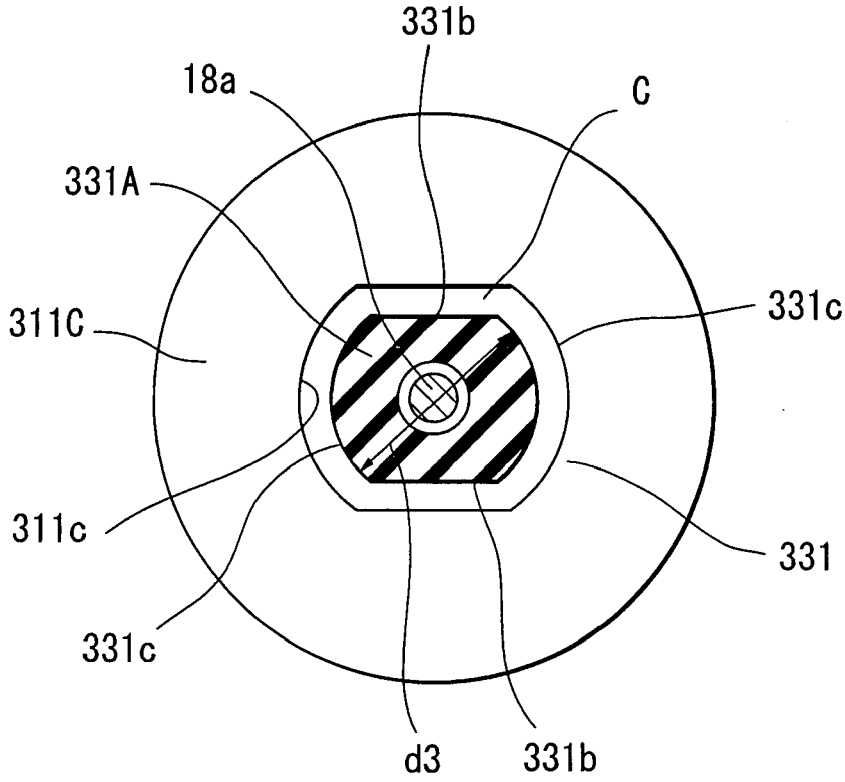
FIG. 8 is a cross-sectional view of a buffer piece and a cylinder head in a nail gun according to a fourth embodiment of the present invention, the cross-section being taken along the line VIII-VIII in FIG. 3.

A buffer piece 331 in a combustion type power tool according to a fourth embodiment is shown in FIG. 8. A buffer piece has a sleeve portion 331A. The sleeve portion 331A does not have a circular cross-section, but has two parallel sides 331*b*, 331*b* and opposing arcuate sides 331*c*, 331*c* defining a diameter d3. A buffer support section 311C of a cylinder head is formed with a center hole 311*c* having a shape the same as and greater than a cross-sectional external contour of the sleeve portion 331A of the buffer piece so as to prevent the buffer piece from being freely rotated relative to the buffer support section 311C.

Figure 9:
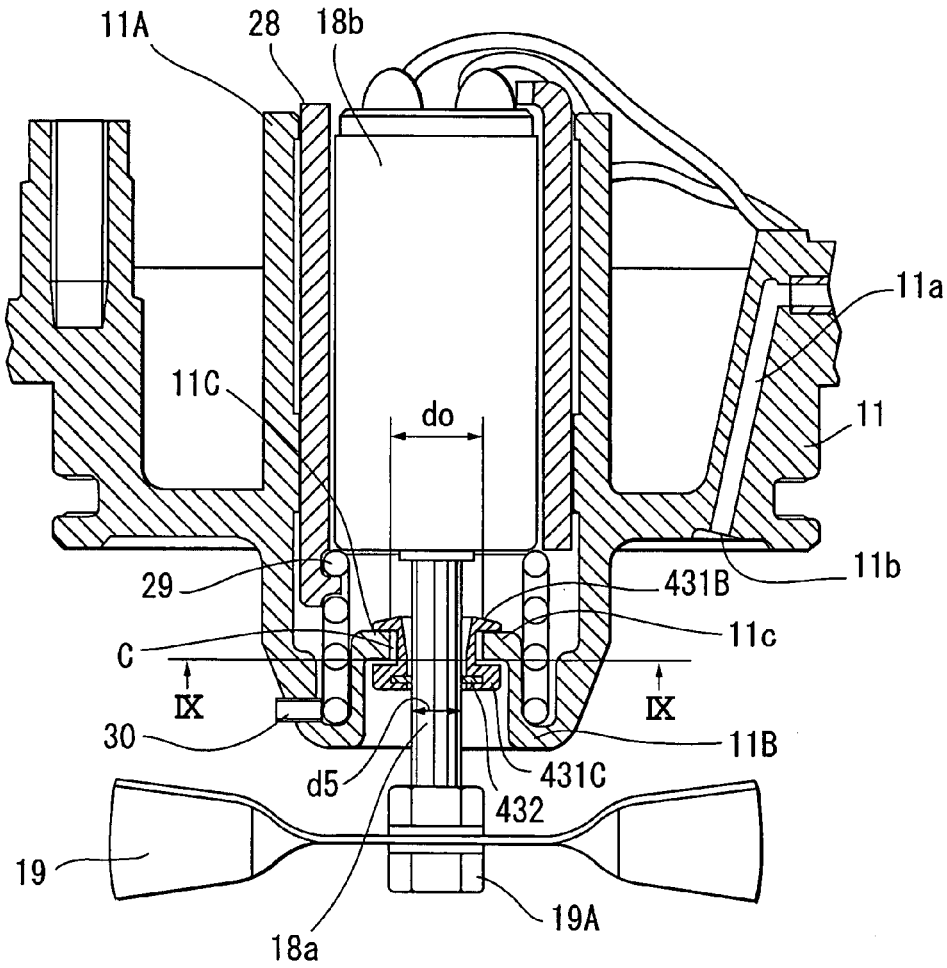
FIG. 9 is a cross-sectional view particularly showing a motor, a motor shaft and a cylinder head in a nail gun according to a fifth embodiment of the present invention.
Figure 10:
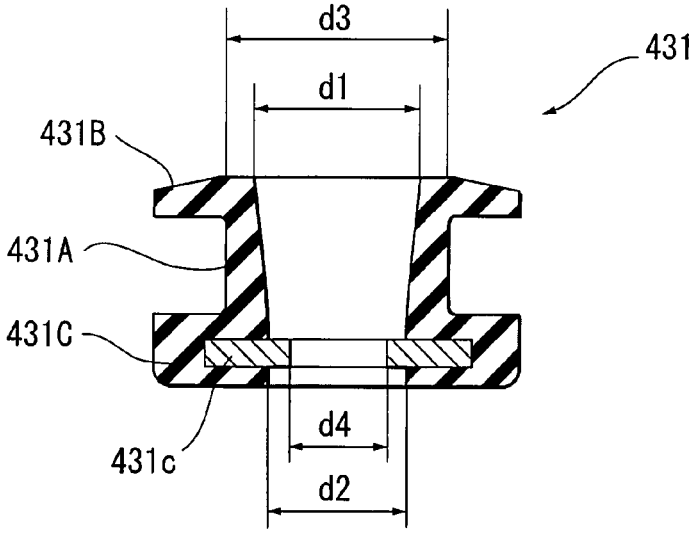
FIG. 10 is an enlarged cross-sectional view of a buffer piece assembled at the cylinder head in the nail gun according to the fifth embodiment.

A combustion type power tool according to a fifth embodiment is shown in FIGS. 9 and 10. In the fifth embodiment, a second flange 431C of a buffer piece 431 made from a rubber is formed with an annular recess 431*c*, and a metal washer 432 made from aluminum or iron is fitted and held in the annular recess 431*c*. The washer 432 can be incorporated in the buffer piece 431 during molding.

Provided that an inner diameter of the washer 432 is d4 and an outer diameter of the drive shaft 18*a* is d5, the dimensional relationship of d1>d2>d4>d5 is provided in order to avoid frictional wearing of the buffer piece 431 due to direct contact with the drive shaft 18*a*. That is, the washer 432 can prevent the rotating drive shaft 18*a* from being in direct contact with the elastic damper piece 431. Thus, the damper piece 431 can be protected against the rotating drive shaft 18*a*. Incidentally, the drive shaft 18*a* of the motor may be contacted with the washer 432. However, since the washer 431 is held by the elastic damper piece 431, the washer 431 can be laterally moved because of the elastic deformation of the damper piece 431 when the drive shaft 18*a* abuts against the washer 431. Thus, the frictional wearing of the washer 431 itself can be lowered.

While the invention has been described in detail and with reference to specific embodiments thereof, it would be apparent to those skilled in the art that various changes and modification may be made therein without departing from the scope of the invention. For example, the present invention is not limited to the nail gun but is available for any kind of power tools in which a combustion chamber and a piston are provided, and as long as expansion of gas as a result of combustion of air-fuel mixture in the combustion chamber causes reciprocal motion of the piston.

Figure 6:
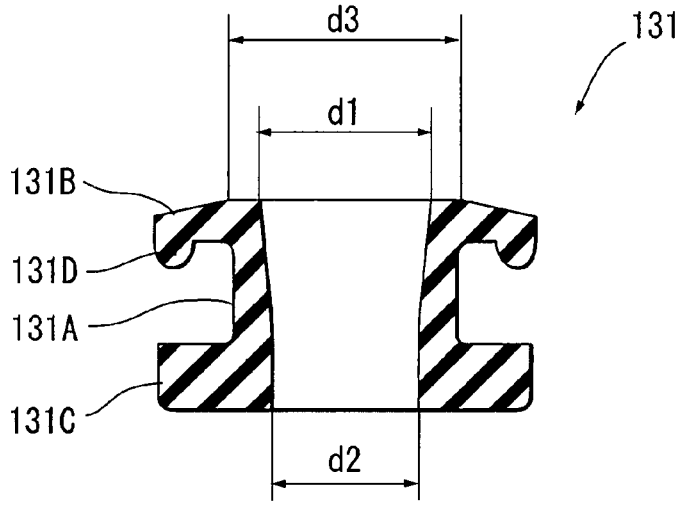
FIG. 6 is an enlarged cross-sectional view of a buffer piece assembled at the cylinder head in the nail gun according to the second embodiment.

Further, the washer 432 can be provided in any types of buffer pieces shown in FIGS. 6 through 8, and annular projection 131D or 231D or both can be provided to the buffer pieces 331 and 431. Furthermore, the projections are not limited to annular shape.

What is claimed is:

1. A combustion-type power tool comprising:

a housing;

a cylinder disposed in the housing;

a piston disposed in the cylinder and movable in an axial direction;

a cylinder head disposed at an end of the housing and having a wall portion extending in a direction perpendicular to the axial direction, the wall portion having an opening;

a motor disposed at the cylinder head and comprising a motor body and a drive shaft extending from the motor body into a combustion chamber through the opening of the wall portion of the cylinder head;

a fan connected to the drive shaft to be rotatable within the combustion chamber; and an elastic member disposed at the opening of the wall portion and having a sleeve portion extending in the axial direction, the sleeve portion having a through-hole through which the drive shaft extends;

wherein an inner surface of the through-hole is tapered with respect to an outer surface of the drive shaft.

2. The combustion-type power tool as defined in claim 1, wherein a diameter of the through-hole at an upper end of the sleeve portion is greater than a diameter of the through-hole at a lower end of the sleeve portion.

3. The combustion-type power tool as defined in claim 1, wherein the elastic member further comprises a first flange portion provided at one end of the sleeve portion and a second flange portion provided at an other end of the sleeve portion, the wall portion of the cylinder head being disposed between the first and the second flange portions of the elastic member.

4. The combustion-type power tool as defined in claim 3, wherein the elastic member further comprises a protrusion extending from the first flange portion toward an upper surface of the wall portion for enabling sealing between the combustion chamber and atmosphere.

5. The combustion-type power tool as defined in claim 3, wherein the elastic member further comprises a protrusion extending from the second flange portion toward a lower surface of the wall portion for enabling sealing between the combustion chamber and atmosphere.

6. The combustion-type power tool as defined in claim 1, wherein the sleeve portion of the elastic member has an outer periphery which is defined by the two parallel flat surfaces and two arcuate surfaces.

7. The combustion-type power tool as defined in claim 6, wherein the opening of the wall portion has an inner surface which is defined by two parallel flat surfaces facing with a gap to the two flat surfaces of the sleeve portion and by two arcuate surfaces facing with a gap to the two arcuates surfaces of the sleeve portion.

8. A combustion-type power tool comprising:

a housing;

a cylinder disposed in the housing;

a piston disposed in the cylinder and movable in an axial direction;

a cylinder head disposed at an end of the housing and having a wall portion extending in a direction perpendicular to the axial direction, the wall portion having an opening;

a motor disposed at the cylinder head and comprising a motor body and a drive shaft extending from the motor body into a combustion chamber through the opening of the wall portion of the cylinder head;

a fan connected to the drive shaft to be rotatable within the combustion chamber; and an elastic member disposed at the opening of the wall portion and comprising a sleeve portion extending in the axial direction and having a through-hole through which the drive shaft extends, a first flange portion and a second flange portion both extending from the sleeve portion in a direction perpendicular to the axial direction;

wherein the wall portion of the cylinder head is located between the first and the second flange portions so that the elastic member is movable in the axial direction.

9. The combustion-type power tool as defined in claim 8, wherein the elastic member further comprises a protrusion extending from the first flange portion toward an upper surface of the wall portion for enabling sealing between the combustion chamber and atmosphere.

10. The combustion-type power tool as defined in claim 8, wherein the elastic member further comprises a protrusion extending from the second flange portion toward a lower surface of the wall portion for enabling sealing between the combustion chamber and atmosphere.

11. A combustion-type power tool comprising:

a housing;

a cylinder disposed in the housing;

a piston disposed in the cylinder and movable in an axial direction;

a cylinder head disposed at an end of the housing and having a wall portion extending in a direction perpendicular to the axial direction, the wall portion having an opening;

a motor disposed at the cylinder head and comprising a motor body and a drive shaft extending from the motor body into a combustion chamber through the opening of the wall portion of the cylinder head;

a fan connected to the drive shaft to be rotatable within the combustion chamber; and a buffer piece disposed at the opening of the wall portion and comprising an elastic member and an annular shaped washer, the elastic member having a sleeve portion extending in the axial direction and having a through-hole through which the drive shaft extends and an annular recess, the washer being disposed in the annular recess of the elastic member.

12. The combustion-type power tool as defined in claim 11, wherein an inner diameter of the washer is smaller than an inner diameter of the through-hole of the sleeve.

13. The combustion-type power tool as defined in claim 12, wherein a diameter of the through-hole at an upper end of the sleeve portion is greater than a diameter of the through-hole at a lower end of the sleeve portion, and the inner diameter of the washer is smaller than the diameters of the through-hole at the upper and lower ends of the sleeve portion.

* * * * *